United States Patent [19]

Howe et al.

[11] Patent Number: 4,512,823

[45] Date of Patent: Apr. 23, 1985

[54] BARIUM OR CHROMIUM ADDITIVES TO MAGNESIUM OXIDE COATING SLURRY

[75] Inventors: Michael W. Howe, Pittsburgh, Pa.; Samuel W. Sopp, Foster City, Calif.

[73] Assignee: Calgon Corporation, Pittsburgh, Pa.

[21] Appl. No.: 598,641

[22] Filed: Apr. 10, 1984

Related U.S. Application Data

[63] Continuation-in-part of Ser. No. 421,664, Sep. 22, 1982, abandoned.

[51] Int. Cl.[3] ..... H01F 1/04

[52] U.S. Cl. ..... 148/113; 148/22; 148/28

[58] Field of Search ..... 148/110, 111, 112, 113, 148/22, 27, 28; 501/108, 114

[56] References Cited

U.S. PATENT DOCUMENTS

| | | | |
|---|---|---|---|
| 3,522,108 | 7/1970 | Yamamoto et al. | 148/6 |
| 3,670,278 | 6/1972 | Foster | 148/31.55 |
| 3,687,742 | 8/1972 | Foster et al. | 148/113 |
| 3,705,826 | 12/1972 | Hirst et al. | 148/113 |
| 4,255,205 | 3/1981 | Morito et al. | 148/113 |
| 4,347,085 | 8/1982 | Hasekorn et al. | 148/113 |

OTHER PUBLICATIONS

The Condensed Chemical Dictionary, 1971, p. 212.

*Primary Examiner*—John P. Sheehan

*Attorney, Agent, or Firm*—M. C. Sudol; R. B. Olson; W. C. Mitchell

[57] ABSTRACT

The instant invention is directed to a slurry for use in coating silicon steel prior to high temperature annealing, comprising magnesium oxide, water and at least one inorganic compound selected from the group consisting of barium oxide, barium nitrate, chromium nitrate, and their hydrates.

The instant invention is also directed to a process for coating silicon steel, comprising coating the steel with a magnesium oxide slurry prior to high temperature annealing, the improvement wherein at least one inorganic compound selected from the group consisting of barium oxide, barium nitrate, chromium nitrate, and their hydrates is pre-mixed in said slurry, thereby minimizing the formation of "tight magnesia" on the steel.

5 Claims, No Drawings

BARIUM OR CHROMIUM ADDITIVES TO MAGNESIUM OXIDE COATING SLURRY

BACKGROUND OF THE INVENTION

This application is a continuation-in-part of U.S. Ser. No. 421,664, filed Sept. 22, 1982 abandoned.

In many fields of use and, in particular, in the electrical industry, it is necessary to provide a coating on ferrous material. This coating desirably performs the function of separating and purifying the ferrous material and reacting with surface silica in the steel to form an electrical insulating layer. For example, in the transformer art, the cores of the transformers are usually formed of a ferrous material, such as silicon steel, which may be provided with a preferred grain growth orientation to provide optimum electrical and magnetic properties. It is necessary to provide a coating on the ferrous material prior to the final high temperature grain growth anneal. This coating performs three separate functions. The first function of the coating is to provide separation of the various turns or layers of the coiled material to prevent their sticking or welding together during high temperature anneals. A second function is that of aiding in the chemical purification of the ferrous material to develop the desired optimum magnetic characteristics of such material. The third function of the coating is to form on the surface of the ferrous material a refractory-type coating which will provide electrical insulation of one layer of ferrous material from the next during its use as a core in a transformer or in other electrical aparatuses, such as motor armatures or the like.

In the present state of the electrical apparatus art, the most widely used coating for the ferrous material which is used as the magnetic core of the electrical apparatus is a coating of magnesium oxide and/or magnesium hydroxide. These coatings are, in general, applied to the ferrous material in the form of a suspension of magnesium oxide and/or magnesium hydroxide in water. The suspension comprises a quantity of magnesium oxide in water and is mixed sufficiently for the desired application; the magnesium oxide may be hydrated to an extent dependent on the character of the oxide used, the duration of mixing and the temperature of the suspension. Therefore, the term magnesium oxide coating is used with reference to a coating of magnesium hydroxide, which may include magnesium oxide which has not been hydrated.

As set forth in U.S. Pat. No. 2,385,332, during a heat treatment at suitable temperatures, magnesium oxide can be caused to react with silica particles on or near the surfaces of previously oxidized silicon-iron sheet stock to form a glass-like coating, which coating is useful as an interlaminary insulator when silicon-iron sheets are used in an electrical apparatus, such as in the core of a transformer.

In the production of silicon steel for the magnetic cores of transformers, the steel is generally annealed to provide optimum grain growth orientation which develops the magnetic properties of the silicon steel. This anneal is usually carried out in a dry hydrogen atmosphere at high temperatures. This anneal also aids in purifying the steel, acting with the coating placed on the steel. During this anneal, a portion of the magnesium oxide coating reacts with the silica on the surface of the silicon steel to form a glass-like coating of magnesium silicate. This glass-like coating provides electrical insulation during the use of the silicon steel in electrical apparatuses, such as the cores of transformers.

The instant invention is directed to a magnesium oxide composition which eliminates "tight magnesia", or excess magnesium oxide which sinters tightly to the annealed coating (glass film) while minimizing the hydration rate in the aqueous coating bath.

A portion of the magnesium oxide coating reacts with the surface silica to form a glass-like magnesium silicate coating. The unreacted portion remains as excess magnesium oxide which must be removed prior to further processing. Generally, this removal is accomplished by mechanical scrubbing with nylon bristle brushes or the like. After scrubbing, if there is a residue, it is termed "tight magnesia" and is undesirable.

There are, of course, other properties for the annealed coating which must be present, but the composition of this invention is directed to minimizing "tight magnesia", while maintaining all the other desirable characteristics. Minimizing "tight magnesia" formation improves the aescetics of the steel, improves the stacking factor of the steel, and improves the production yield by lessening the quantities of unacceptable steel caused by "tight magnesia" deposits.

DESCRIPTION OF THE INVENTION

The instant invention is directed to a slurry for use in the initial coating of silicon steel prior to high temperature annealing, comprising 8 to 15 percent by weight magnesium oxide, at least 0.01 mole percent, on a magnesium oxide basis, of at least one inorganic compound selected from the group consisting of barium oxide, barium nitrate, cbromium nitrate, and their hydrates, and the balance water.

The instant invention is also directed to a process for coating silicon steel, comprising initially coating the steel with a magnesium oxide slurry prior to high temperature annealing, the improvement wherein at least one inorganic compound selected from the group consisting of barium oxide, barium nitrate, chromium nitrate, and their hydrates is pre-mixed in the slurry so as to form a slurry that comprises 8 to 15 percent by weight magnesium oxide, at least 0.01 mole percent, on a magnesium oxide basis, of an inorganic compound selected from the group consisting of barium oxide, barium nitrate, chromium nitrate, and their hydrates, and the balance water.

The high temperature anneal provides optimum grain growth orientation which develops the magnetic properties of the silicon steel. This anneal is usually carried out in a dry hydrogen atmosphere at temperatures ranging from approximately 950° to 1500° C. for about 2 to about 50 hours.

The percent of magnesium oxide in the slurry is preferably 8 to 15 percent, by weight. The inorganic compound is preferably at least 0.01 mole percent on a magnesium oxide basis and, most preferably, 0.1 to 1.0 mole percent on a magnesium oxide basis. The balance of the slurry is water. Thus, for each 100 moles of magnesium oxide in the slurry which contains 8–15%, by weight, magnesium oxide, at least 0.01 mole of the inorganic compound is required and, most preferably, 0.1 to 1.0 mole of the inorganic compound is required.

EXAMPLES 1 THROUGH 4

Magnesium oxide slurries were prepared at a concentration of one pound of magnesium oxide per gallon of water. Each slurry was coated onto a strip of decarburized silicon steel using grooved metering rollers. The slurry-coated steel was then dried at about 500° to 600° C. The resulting coatings had a coating weight of about 0.015 ounce/foot$^2$ per side. The coated coil was then annealed in a dry hydrogen atmosphere at about 1,200° C. for 30 hours. Following the hydrogen anneal, the coils were cooled and scrubbed. The scrub was accomplished using electrically-driven nylon brushes and water at about 130° F. After scrubbing, the annealed steel was inspected and the amount of residual magnesium oxide was determined. These values are shown in Table I as tight magnesia. Tight magnesia is reported as a percent of the surface area of the coil. Under the heading of "MgO Formulation" in Table I, the analysis of the magnesium oxide used to form the slurries of Examples 1 through 4 is shown. The comparison Example (Example 1) comprised a slurry of magnesium oxide and water. In Examples 2, 3 and 4, 0.1 mole percent on a magnesium oxide basis of $Cr(NO_3)_3$, $Ba(OH)_2.8H_2O$ and BaO were added to the magnesium oxide/water slurry, respectively. The data shows that all three of these compounds greatly reduce the percent tight magnesia remaining on the steel strips.

TABLE I

| MgO Formulation | Comparison Example 1 | Examples 2 | 3 | 4 |
|---|---|---|---|---|
| % MgO | 97.98 | 97.98 | 97.98 | 97.98 |
| % CaO | 0.44 | 0.44 | 0.44 | 0.44 |
| % $SiO_2$ | 0.34 | 0.34 | 0.34 | 0.34 |
| % B | 0.13 | 0.13 | 0.13 | 0.13 |
| Mn (ppm) | 80 | 80 | 80 | 80 |
| Additive | | | | |
| Mole % $Cr(NO_3)_3$ | — | 0.1 | — | — |
| Mole % $Ba(OH)_2.8H_2O$ | — | — | 0.1 | — |
| Mole % BaO | — | — | — | 0.1 |
| Characteristics | | | | |
| Citric Acid Activity (sec.) | 80–118 | 80–118 | 80–118 | 80–118 |
| Bulk Density (pcf) | 21–22 | 21–22 | 21–22 | 21–22 |
| Particle Size, Average (μ) | 12.7 | 12.7 | 12.7 | 12.7 |
| Results (% Heavy Tight Magnesia) | | | | |
| Top | 11.8 | 0.0 | 0.9 | 3.0 |
| Bottom | 21.4 | 0.0 | 1.7 | 7.4 |

EXAMPLE 5

A magnesium oxide slurry was prepared similar to the slurry described in Examples 1 through 4. However, instead of $Cr(NO_3)_3$, $Ba(OH)_2.8H_2O$ or BaO, $Cr_2O_3$ was used as the additive. This slurry contained 2 percent $Cr_2O_3$ by weight on a magnesium oxide basis. The $MgO/Cr_2O_3$ slurry was coated onto a strip of decarburized silicon steel using grooved metering rollers. The slurry-coated steel was then dried, annealed and scrubbed as described in Examples 1 through 4. Tight magnesia adhered to 100 percent of the strip after scrubbing.

EXAMPLE 6

A magnesium oxide slurry was prepared similar to the slurry described in Examples 1 through 4. However, instead of $Cr(NO_3)_3$, $Ba(OH)_2.8H_2O$ or BaO, $Cr_2O_3$ was used as the additive. This slurry contained 5 percent $Cr_2O_3$ by weight on a magnesium oxide basis. The $MgO/Cr_2O_3$ slurry was coated onto a strip of decarburized silicon steel using grooved metering rollers. The slurry-coated steel was then dried, annealed and scrubbed as described in Examples 1 through 4. Tight magnesia adhered to 100 percent of the strip after scrubbing.

What is claimed is:

1. A slurry for use in the initial coating of silicon steel prior to high temperature annealing, comprising 8 to 15 percent by weight magnesium oxide, at least 0.01 mole percent, on a magnesium oxide basis, of at least one inorganic compound selected from the group consisting of barium oxide, barium nitrate, chromium nitrate, and their hydrates, and the balance water.

2. The slurry of claim 1, wherein said slurry comprises 0.1 to 1.0 mole percent, on a magnesium oxide basis, of said inorganic compound.

3. A process for coating silicon steel, comprising initially coating the steel with a magnesium oxide slurry prior to high temperature annealing, the improvement wherein at least one inorganic compound selected from the group consisting of barium oxide, barium nitrate, chromium nitrate, and their hydrates is pre-mixed in the slurry so as to form a slurry that comprises 8 to 15 percent by weight magnesium oxide, at least 0.01 mole percent, on a magnesium oxide basis, of an inorganic compound selected from the group consisting of barium oxide, barium nitrate, chromium nitrate, and their hydrates, and the balance water.

4. The process of claim 3, wherein said slurry comprises 0.1 to 1 mole percent, on a magnesium oxide basis, of said inorganic compound.

5. The process of claim 3, wherein said high temperature annealing is carried out in a dry hydrogen atmosphere at temperatures ranging from approximately 950° to 1,500° C. for about 2 to 50 hours.

* * * * *